US007243456B2

(12) United States Patent
Williams et al.

(10) Patent No.: US 7,243,456 B2
(45) Date of Patent: Jul. 17, 2007

(54) UNIVERSAL SCOPE MOUNT

(75) Inventors: Dean N. Williams, Griffin, GA (US); Ned J. Hollenbach, Murfreesboro, AR (US); Mark D. Hendricks, Norcross, GA (US)

(73) Assignee: Blackpowder Products, Inc., Norcross, GA (US)

( * ) Notice: Subject to any disclaimer, the term of this patent is extended or adjusted under 35 U.S.C. 154(b) by 0 days.

(21) Appl. No.: 11/178,811

(22) Filed: Jul. 11, 2005

(65) Prior Publication Data

US 2007/0006512 A1 Jan. 11, 2007

(51) Int. Cl.
*F41G 1/38* (2006.01)

(52) U.S. Cl. ..... 42/125; 42/124

(58) Field of Classification Search ..... 42/124, 42/125, 126, 127, 128
See application file for complete search history.

(56) References Cited

U.S. PATENT DOCUMENTS

| | | | | |
|---|---|---|---|---|
| 2,743,526 | A | 5/1956 | Ivy | |
| 3,260,001 | A | 7/1966 | Weaver | |
| 3,835,565 | A | 9/1974 | Weast | |
| 3,877,166 | A | 4/1975 | Ward | |
| 3,880,389 | A * | 4/1975 | Burris | 248/205.1 |
| 4,164,076 | A | 8/1979 | Carrigan | |
| 4,216,600 | A * | 8/1980 | Brueckner et al. | 42/127 |
| 4,249,315 | A | 2/1981 | Hopson, III | |
| 4,446,644 | A | 5/1984 | Jimenez et al. | |
| 4,509,282 | A | 4/1985 | McMillon | |
| 4,688,345 | A | 8/1987 | Kilgour | |
| 4,776,126 | A | 10/1988 | Williams | |
| 4,862,624 | A | 9/1989 | Williams | |
| 4,873,779 | A | 10/1989 | Ellison et al. | |
| 5,208,407 | A | 5/1993 | Stover | |
| D343,440 | S | 1/1994 | Rubin et al. | |
| 5,375,361 | A * | 12/1994 | Rustick | 42/125 |
| 5,396,725 | A * | 3/1995 | Talbot | 42/127 |
| 5,428,915 | A | 7/1995 | King | |
| 5,433,010 | A * | 7/1995 | Bell | 42/126 |
| 5,481,818 | A | 1/1996 | Stover | |
| 5,684,467 | A | 11/1997 | Hur | |
| 5,694,712 | A | 12/1997 | Plonka | |
| 5,805,071 | A | 9/1998 | Hur | |
| 6,701,660 | B2 | 3/2004 | Stover | |
| D502,244 | S * | 2/2005 | Oz | D22/109 |

OTHER PUBLICATIONS

Connecticut Valley Arms 2001 Catalog, Jan. 2001, cover page & p. 16.
CVA Universal In-Line Scope Mounts, SKU No. AC1666; Jan. 2001; 3 pgs.

* cited by examiner

*Primary Examiner*—Stephen M. Johnson
*Assistant Examiner*—Benjamin P. Lee
(74) *Attorney, Agent, or Firm*—Gardner Groff Greenwald & Villanueva, P.C.

(57) ABSTRACT

A system and method for mounting a telescopic sight or "scope" to a firearm. The system is convertible or universal, in that it includes interchangeable mounting plate inserts allowing the mounting plate to be installed onto two or more different types of firearms having differing mounting hole configurations.

23 Claims, 2 Drawing Sheets

UNIVERSAL SCOPE MOUNT

TECHNICAL FIELD

The present invention relates generally to the field of firearm accessories, and more particularly to a universal scope mount suited for use in mounting telescopic sights to different types of firearms, without the need for modification of the firearm.

BACKGROUND OF THE INVENTION

Target shooters, hunters, and other users of firearms often mount telescopic gun sights or "scopes" to a firearm for improved accuracy. Typically, the barrel and/or receiver portion of a firearm, such as for example a muzzle-loading or breach-loading firearm, is drilled and tapped with a plurality of mounting holes for optional attachment of a mounting plate or base. Scope mounting rings engage the scope and are clamped to the mounting plate to securely affix the scope to the firearm.

Different manufacturers and/or models of firearms, however, commonly utilize different configurations of mounting holes. For example, firearm Manufacturer A may drill and tap its receivers for one type of threaded fasteners spaced a lesser distance apart, whereas firearm Manufacturer B drills its receivers for another type of threaded fasteners at a greater distance apart. As a result, a different mounting plate must be utilized to mount a scope to Manufacturer A's firearms than is used to mount a scope to Manufacturer B's firearms. This requires retailers to stock multiple mounting hardware types, increasing inventory costs and space requirements. And consumers shopping for scope mounting hardware are forced to study the various hardware to determine which is appropriate for mounting a scope to their particular firearm, which is time-consuming, inconvenient, and sometimes leads to incorrect purchases that must be returned and exchanged. Also, if a user wishes to remove a scope from one firearm and remount it onto another firearm, new mounting hardware is often required.

Thus it can be seen that needs exist for improved mounting hardware for attachment of a scope to a firearm, which eliminates the need for particularized components for different variations of mounting hole configurations. It is to the provision of a universal scope mount meeting this and other needs that the present invention is primarily directed.

SUMMARY OF THE INVENTION

The present invention provides a more convenient means of mounting a scope to a firearm. In one aspect, the present invention is a universal or convertible scope mount that is adaptable for use with different firearms, having different mounting hole configurations. In an example embodiment, the scope mount of the present invention includes at least one mounting plate or base that receives an interchangeable insert, wherein changing out the insert converts the mounting plate to use with firearms having different mounting hole configurations. In this manner, a retailer need only stock one type of mounting hardware for multiple types of firearms with different mounting hole configurations. And consumers will not face the inconvenience of discerning which type of mounting hardware they need, or having to return and exchange an incorrect purchase. Also, if the user desires to remove a scope from one firearm and remount it onto another firearm, new mounting hardware will not be required.

In another aspect, the invention is a mounting plate for attaching a scope to a firearm. The mounting plate preferably includes a body portion having a bore for receiving a first fastener, and a chamber formed therein. The mounting plate preferably further includes an insert positionable within the chamber, and having a bore for receiving a second fastener.

In still another aspect, the invention is a mounting system for affixing a telescopic gun sight to a firearm. The mounting system preferably includes a mounting plate body portion having a bore extending therethrough for alignment with a first mounting hole of the firearm, and a mounting plate insert positionable relative to the mounting plate body portion to align a bore extending through the mounting plate insert with a second mounting hole of the firearm.

And in another aspect, the invention is a method of mounting a scope to a firearm. The method preferably includes the steps of assembling a mounting plate by installing an interchangable mounting plate insert into cooperative engagement with a mounting plate body portion, securing the mounting plate to a firearm with a first threaded fastener extending through the mounting plate body portion and a second threaded fastener extending through the interchangable mounting plate insert, and mounting at least one scope ring to the mounting plate.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
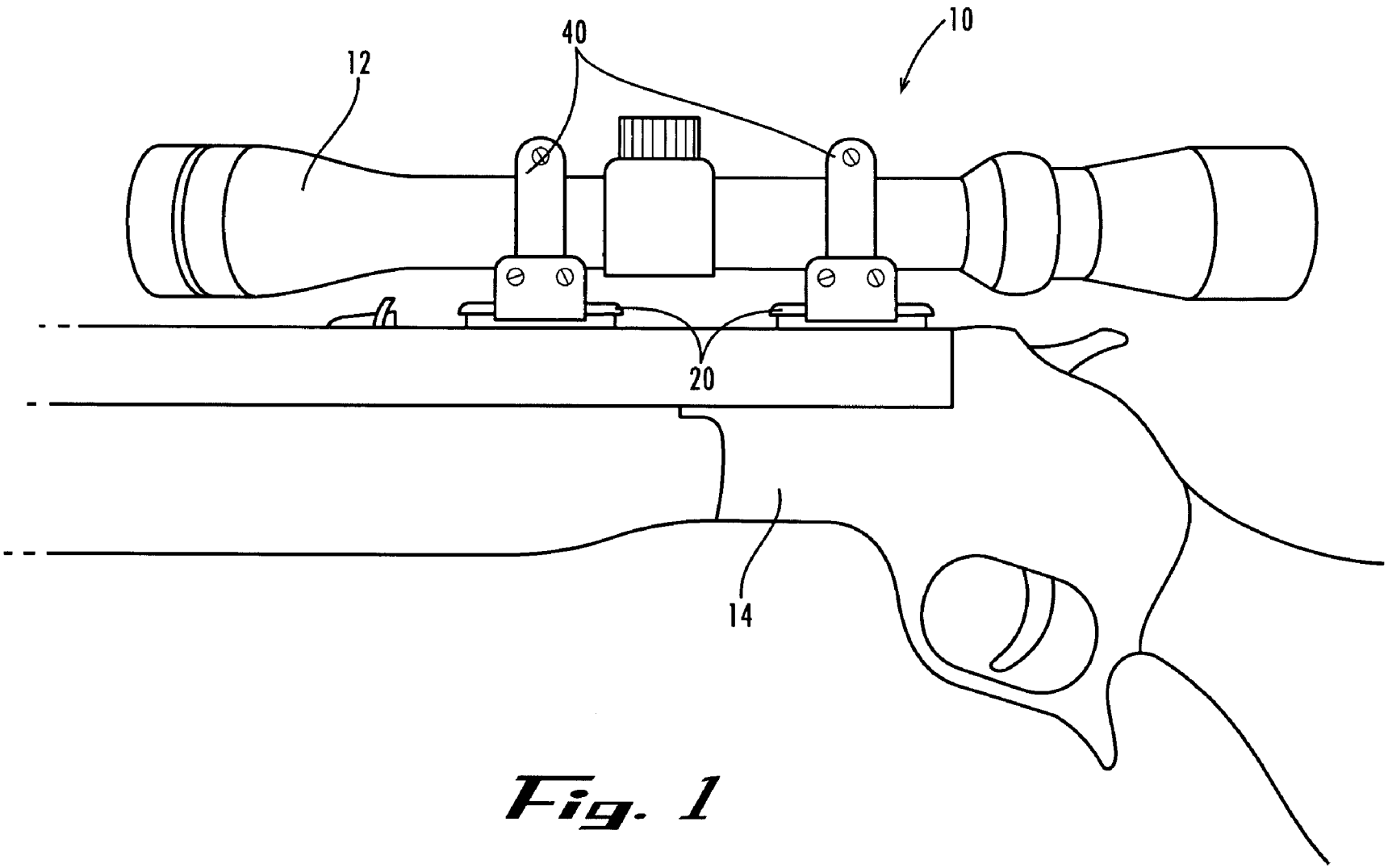
FIG. 1 shows a firearm having a scope mounted thereon using a mounting system according to an example embodiment of the present invention.
Figure 2:
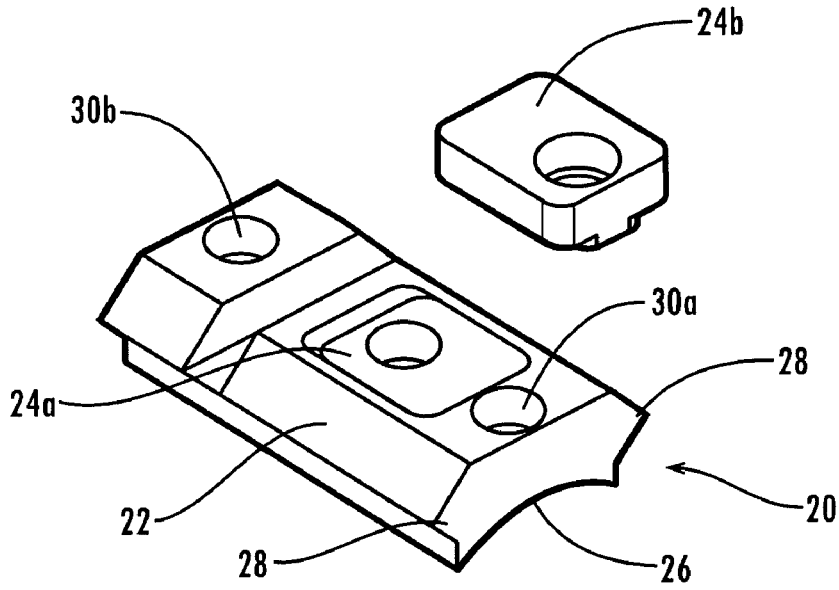
FIG. 2 shows a perspective view of a scope mounting plate according to an example embodiment of the present invention.
Figure 3:
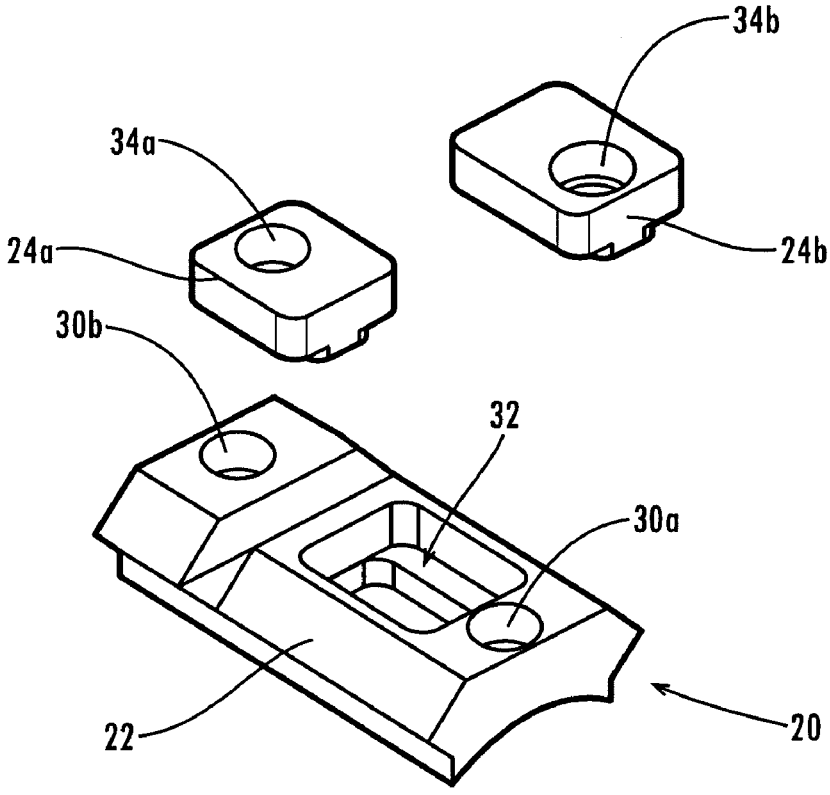
FIG. 3 shows the scope mounting plate of FIG. 2, with a first insert being interchanged for a second insert.

FIGS. 1–3 show a mounting system 10 for affixing a telescopic gun sight or scope 12 to a firearm 14 according to an example form of the present invention. The mounting system 10 preferably includes at least one mounting plate or base 20 for attachment to the barrel or receiver portion of the firearm 14. In the embodiment depicted in FIG. 1, two mounting plates are affixed at positions spaced a distance apart along the lengthwise direction of the barrel. In alternate embodiments, a single mounting plate, or three or more mounting plates are provided. The scope 12 preferably includes internal optics and sighting indicia in typical form, and is preferably engaged within mounting rings 40, which clamp onto or otherwise engage the mounting plate 20 to securely affix the scope to the firearm 14. The scope 12 preferably can slide forward and backward within the rings 40 for positional adjustment relative to the firearm to suit a particular user when the rings are loosened. Threaded fasteners are preferably provided for tightening the rings 40 against the tube of the scope 12, and for clamping opposed jaws of the rings against the mounting plate 20.

The mounting plate 20 of the present invention is shown in greater detail in FIGS. 2 and 3. The mounting plate 20 preferably includes a body portion 22 and an interchangeable insert 24. Optionally, two or more interchangeable inserts 24*a*, 24*b* are provided. The body portion 22 may have a radiused lower face 26 for attachment to a barrel having a circular profile, or a planar lower face for attachment to a flat receiver portion of the firearm. In example forms of the invention, the body portion 22 comprises opposed upper flanges 28, against which the jaws of the scope rings 40 are clamped. In alternate forms, the scope rings include dovetail members, studs, recesses, set-screws, or other engagement means, for coupling with cooperating elements or surface features of the body portion. A transverse slot is optionally provided across the upper surface of the body portion 22, for receiving a recoil lug of the scope ring, to provide more rigid coupling between the firearm and the scope. The body portion 22 preferably includes at least one bore 30 at a first end thereof, which bore is preferably drilled and countersunk to receive a machine screw or other threaded fastener for securing the mounting plate to the firearm. In one embodiment of the invention, a single bore 30 is provided, the bore preferably being configured to receive two or more different types of fastener. In the depicted embodiment, first and second bores 30*a*, 30*b* are provided at first and second ends of the body portion 22, respectively; and bore 30*a* is configured to receive a first type of fastener, and bore 30*b* is configured to receive a second type of fastener.

The body portion 22 preferably also includes a recess or chamber 32, formed in its upper surface and positioned between the first and second ends thereof. A slotted opening extends through the body portion along the length of the chamber 32 to permit a fastener to pass therethrough into engagement with one of the mounting holes of the firearm. The chamber 32 preferably has an internal size and shape configured to receive a selected interchangeable insert 24. The inserts 24 are preferably generally T-shaped in end profile, having a flange or rib projecting from a lower face thereof, which fits closely within the slotted opening through the body portion along the bottom of the chamber 32, to minimize or eliminate play between the insert and the body portion when assembled, providing a secure and rigid mounting base. Each interchangeable insert 24 has a bore 34 formed therethrough, which bore is preferably drilled and countersunk to receive a machine screw or other threaded fastener. In preferred form, the bore size and/or lengthwise positional location of the bore on the insert differs for each type of interchangeable insert 24. For example, inserts 24*a* of a first type have a bore 34*a* configured to receive a #6×48 screw, with the bore located a first distance from an end of the insert; whereas inserts 24*b* of a second type have a bore 34*b* configured to receive a #8×40 screw, with the bore located a second distance (different from the first distance) from an end of the insert. If the body portion 22 includes multiple bores 30, a first bore 30*a* of the body portion preferably matches the bore 34*a* of the first insert type 24*a*, and a second bore 30*b* of the body portion preferably matches the bore 34*b* of the second insert type 24*b*. Likewise, the positional location of the bore 34 on each type of insert 24 results in a spacing between the matching or cooperating bores of the insert and the body portion, which bore spacing matches the spacing of mounting holes of a particular firearm type, so that the bores align with mounting holes of the firearm. The chamber 32 and the inserts 24 are preferably non-circular, for example generally rectangular as depicted, or oval or elliptical, to prevent the insert from rotating within the chamber. Alternatively, the inserts and chamber are circular in profile, with the bore in the insert located off-center, whereby rotational adjustment of the insert within the chamber provides adjustment of the bore spacing.

Interchanging one insert type for another allows the mounting plate 20 to be mounted to firearms having different mounting hole configurations, thereby providing a convertible or universal scope mounting system. For example, the bore sizes and resulting spacing between bore 30*a* of the body portion 22 and bore 34*a* of the insert, when the first insert type 24*a* is installed in chamber 32, match the fastener size and mounting hole spacing of a firearm of Manufacturer A, allowing the mounting system to be used to mount a scope to a first firearm type A. And the bore sizes and resulting spacing between bore 30*b* of the body portion and bore 34*b* of the insert, when the second insert type 24*b* is installed in chamber 32, match the fastener size and mounting hole spacing of a firearm of Manufacturer B, allowing the mounting system to be used to mount a scope to a second firearm type B. In alternate embodiments, the body portion 22 includes one or more bores adapted to receive a single size of fastener, and the insert(s) 24 are also bored to receive that same size of fastener. Swapping one insert 24*a* for another insert 24*b*, or varying the system to be mounted to firearms with mounting hole configurations that use the same size of fasteners, but differ in mounting hole spacing.

In one form of the invention, a user purchases one or more mounting plate body portions 22, and one interchangeable insert 24 for each body portion, wherein the insert(s) is/are configured for mounting to a particular firearm type. In this form of the invention, if the user later desires to use the mounting system with another firearm type having a different mounting hole configuration, they would then separately purchase different interchangeable inserts configured for that firearm type. In another form of the invention, a user receives a kit comprising two or more interchangeable inserts 24*a*, 24*b*, etc., for each mounting plate body portion 22, wherein the insert(s) 24*a* is/are configured for mounting to a firearm having a first mounting hole configuration, and the insert(s) 24*b* is/are configured for mounting to another firearm having a second and different mounting hole configuration (and optionally, additional insert types 24*c*, 24*d*, etc., for still further different mounting hole configurations).

In this form of the invention, the user selects and installs the appropriate insert type for their particular firearm's mounting hole configuration, and stores the unused inserts for later use, if/when they desire to use the mounting hardware with a different type of firearm. Each variation of insert 24 is optionally marked, for example by engraving, color-coding or labeling, to distinguish different insert types.

To use the mounting system 10 of the present invention, a user selects the appropriate insert 24 for the firearm to which a scope is to be mounted. The insert 24 is installed in the chamber 32 of the mounting plate body portion 22 to complete the assembly of the mounting plate 20. Fasteners are inserted through the appropriate bore 30 of the body portion and the bore 34 of the insert, and are tightened into the mounting holes of the firearm 14. Optionally, a second mounting plate is affixed to the firearm in like manner. The scope 12 is positioned within the scope rings 40, and the scope rings are clamped or otherwise mounted to the mounting plate(s) 20, thereby securely affixing the scope to the firearm 14.

In further embodiments of the invention, the desired convertibility or universality of use with firearms having different mounting hole configurations is achieved by providing a single insert 24 with multiple bores, wherein each bore is sized and located for use with a particular mounting hole configuration. Alternatively, the lengths of different insert types vary, to provide proper alignment with mounting holes of differing mounting hole configurations. In still further forms of the invention, a single insert 24 has an off-center bore 34 that is positioned a greater distance from one end of the insert, and a lesser distance from the other end of the insert, whereby rotating the orientation of the insert within the chamber 32 of the body portion by 180° results in first and second bore spacings matching first and second mounting hole configurations. In further embodiments of the invention, a single insert 24 is configured to accept different fastener types, and is translational and selectively positionable at different locations relative to the mounting plate body portion 22, for alignment with mounting holes of different hole spacings.

While the invention has been described with reference to preferred and example embodiments, it will be understood by those skilled in the art that a variety of modifications, additions and deletions are within the scope of the invention, as defined by the following claims.

What is claimed is:

1. A mounting plate for attaching a scope to a firearm, said mounting plate comprising:

a body portion having a chamber formed therein, and first and second bores on opposite ends of the chamber; and first and second inserts interchangeably positionably within the chamber, and each having a bore therethrough for receiving a second fastener, wherein the bore through the first insert matches the first bore of the body portion, and wherein the bore through the second insert matches the second bore of the body portion.

2. The mounting plate of claim 1, wherein the insert is selectively positionable within the chamber.

3. The mounting plate of claim 1, wherein the body portion further comprises opposed upper flanges for engagement with a scope ring.

4. A mounting plate for attaching a scope to a firearm, said mounting plate comprising:

a body portion having a chamber formed therein, and first and second bores on opposite ends of the chamber; and first and second inserts interchangeably positionable within the chamber, and each having a bore therethrough for receiving a second fastener, wherein a lesser bore spacing is defined between the bore through the first insert and the first bore of the body portion when the first insert is positioned within the chamber, and wherein a greater bore spacing is defined between the bore through the second insert and the second bore of the body portion when the second insert is positioned within the chamber.

5. The mounting plate of claim 4, wherein the insert is selectively positionable within the chamber.

6. The mounting plate of claim 4, wherein the body portion further comprises opposed upper flanges for engagement with a scope ring.

7. A mounting system for affixing a telescopic gun sight to a firearm, said mounting system comprising:

a mounting plate body portion having first and second bores on opposite sides thereof, the bores extending through the mounting plate body portion for alignment of one of the first and second bores with a first mounting hole of the firearm; and first and second mounting plate inserts interchangeably positionable relative to the mounting plate body portion to align a bore extending through one of the first and second mounting plate inserts with a second mounting hole of the firearm.

8. The mounting system of claim 7, wherein the bore through the first mounting plate insert matches the first bore of the mounting plate body portion, and wherein the bore through the second mounting plate insert matches the second bore of the mounting plate body portion.

9. The mounting system of claim 7, wherein a lesser bore spacing is defined between the bore through the first mounting plate insert and the first bore of the mounting plate body portion when the first mounting plate insert is installed, and wherein a greater bore spacing is defined between the bore through the second mounting plate insert and the second bore of the mounting plate body portion when the second insert is installed.

10. The mounting system of claim 7, wherein the mounting plate body portion comprises a recess for receiving the mounting plate insert.

11. The mounting system of claim 10, wherein the mounting plate insert is selectively positionable within the recess.

12. The mounting system of claim 7, wherein the mounting plate body portion further comprises means for engagement with a scope ring.

13. The mounting system of claim 7, further comprising at least one scope ring for cooperative engagement with the mounting plate body portion.

14. The mounting system of claim 7, further comprising threaded fasteners for attachment to the firearm.

15. A mounting system for affixing a telescopic gun sight to a firearm, said mounting system comprising:

a mounting plate body portion having a bore extending therethrough for alignment with a first mounting hole of the firearm; and first and second mounting plate inserts interchangeably positionable relative to the mounting plate body portion to align a bore extending through one of the first and second mounting plate inserts with a second mounting hole of the firearm.

16. The mounting system of claim 15, wherein the mounting plate body portion comprises first and second bores on opposite sides thereof.

17. The mounting system of claim 15, wherein the bore through the first mounting plate insert matches the first bore of the mounting plate body portion, and wherein the bore through the second mounting plate insert matches the second bore of the mounting plate body portion.

18. The mounting system of claim 15, wherein a lesser bore spacing is defined between the bore through the first mounting plate insert and the first bore of the mounting plate body portion when the first mounting plate insert is installed, and wherein a greater bore spacing is defined between the bore through the second mounting plate insert and the second bore of the mounting plate body portion when the second insert is installed.

19. The mounting system of claim 15, wherein the mounting plate body portion comprises a recess for receiving the mounting plate insert.

20. The mounting system of claim 19, wherein the mounting plate insert is selectively positionable within the recess.

21. The mounting system of claim 15, wherein the mounting plate body portion further comprises means for engagement with a scope ring.

22. The mounting system of claim 15, further comprising at least one scope ring for cooperative engagement with the mounting plate body portion.

23. The mounting system of claim 15, further comprising threaded fasteners for attachment to the firearm.

* * * * *